US007418393B2

(12) United States Patent
Abiko et al.

(10) Patent No.: US 7,418,393 B2
(45) Date of Patent: Aug. 26, 2008

(54) DATA REPRODUCTION DEVICE, METHOD THEREOF AND STORAGE MEDIUM

(75) Inventors: Yukihiro Abiko, Kawasaki (JP); Hideo Kato, Kawasaki (JP); Tetsuo Koezuka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 451 days.

(21) Appl. No.: 09/788,514

(22) Filed: Feb. 21, 2001

(65) Prior Publication Data

US 2001/0047267 A1 Nov. 29, 2001

(30) Foreign Application Priority Data

May 26, 2000 (JP) ..... 2000-157042

(51) Int. Cl.
*G10L 21/04* (2006.01)

(52) U.S. Cl. ..... 704/500

(58) Field of Classification Search ..... 704/222, 704/230, 500–504, 228, 267; 348/390; 375/240.01, 375/240.03

See application file for complete search history.

(56) References Cited

U.S. PATENT DOCUMENTS

| | | | | |
|---|---|---|---|---|
| 5,611,018 A | | 3/1997 | Tanaka et al. | |
| 5,765,136 A | | 6/1998 | Fukuchi | |
| 5,809,454 A | * | 9/1998 | Okada et al. | 704/214 |
| 5,982,431 A | * | 11/1999 | Chung | 375/240.01 |
| 6,484,137 B1 | * | 11/2002 | Taniguchi et al. | 704/211 |

FOREIGN PATENT DOCUMENTS

| | | |
|---|---|---|
| JP | 58-216300 | 12/1983 |
| JP | 63-91873 | 4/1988 |
| JP | 7-192392 | 7/1995 |
| JP | 7-281690 | 10/1995 |
| JP | 7-281691 | 10/1995 |
| JP | 8-237135 | 9/1996 |
| JP | 8-315512 | 11/1996 |
| JP | 8-328586 | 12/1996 |
| JP | 9-7294 | 1/1997 |
| JP | 9-7295 | 1/1997 |
| JP | 2612868 | 2/1997 |
| JP | A-9-73299 | 6/1997 |
| JP | 10-143193 | 5/1998 |
| JP | 10-222169 | 8/1998 |
| JP | 10-301598 | 11/1998 |
| JP | 11-355145 | 12/1999 |
| JP | 3017715 | 12/1999 |
| JP | 2000-99097 | 4/2000 |

OTHER PUBLICATIONS

Office Action issued in corresponding Japanese Patent Application No. 2000-157042, mailed on Mar. 18, 2008.
Japanese Patent Office Action mailed Dec. 18, 2007 for corresponding Japanese Patent Application No. 2000-157042.

* cited by examiner

*Primary Examiner*—Abul Azad
(74) *Attorney, Agent, or Firm*—Staas & Halsey LLP

(57) ABSTRACT

A frame, which is the data unit, is extracted without decoding MPEG audio data. Then, a scale factor included in the frame is extracted and an evaluation function is calculated based on the scale factor. If the value of the evaluation function is larger than a prescribed threshold value, the speed of the frame is converted. If the value of the evaluation function is smaller than the prescribed threshold value, the frame is judged to be a frame in a silent section and neglected. The speed conversion is made by thinning out frames or repeating the same frame as many times as required according to prescribed rules.

15 Claims, 17 Drawing Sheets

DATA REPRODUCTION DEVICE, METHOD THEREOF AND STORAGE MEDIUM

BACKGROUND OF THE INVENTION

1. Field of the Invention

The present invention relates to a data reproduction device and a reproduction method.

2. Description of the Related Art

Thanks to the recent development of digital audio recording technology, it is popular to record voice in an MD using an MD recorder instead of the conventional tape recorder. Furthermore, movies, etc., begins to be publicly distributed by using a DVD, etc., instead of the conventional videotape. Although a variety of technologies are used for such a digital audio recording technology and video recording technology, MPEG is one of the most popular technologies.

FIGS. 1 and 2 show the format of MPEG audio data.

As shown in FIG. 1, the MPEG audio data are composed of frames called AAU (Audio Access Unit or Audio Frame). The frame also has a hierarchical structure composed of a header, an error check, audio data and ancillary data. Here, the audio data are compressed.

The header is composed of information about a syncword, a layer and a bit rate, information about a sampling frequency, data, such as a padding bit, etc. This structure are common to layers I, II and III. However, the compression performances are different.

The audio data in the frame are composed as shown in FIG. 2. As shown in FIG. 2, the audio data always include a scale factor, regardless of layers I, II and III. This scale factor is data for indicating a reproduction scale factor of a wave. Specifically, since audio data indicated by the sampling data of layers I and II or the Huffman code bit of layer III are normalized by the scale factor, actual audio data can be obtained by multiplying the sampling data or data that are obtained by expanding the Huffman code bit, by the scale factor. The scale factor is further divided and compressed into 32 sections (sub-bands) along a time axis, and in the case of monaural sound, at maximum 32 scale factors are allocated.

For the details of the MPEG audio data, refer to ISO/IEC 11172-2, which is the international standard.

FIG. 3 shows the basic configuration of the conventional MPEG audio reproduction device.

If MPEG audio data are inputted to an MPEG audio input unit 10, the data are decoded in an MPEG audio decoding unit 11 for implementing processes specified in the international standard, and voice is outputted from an audio output unit 12 composed of a speaker, etc.

If digitally recorded voice is reproduced, a reproduce speed is frequently changed. Therefore, in particular, the speech speed conversion function is useful for both content understanding and content compression. However, if the speech speed of MPEG audio data is directly converted, conventionally the speech speed was converted after the data were decoded.

MPEG audio data can be compressed into one several tenth. Therefore, if the speech speed is converted after MPEG audio data are decoded, enormous data must be processed after the compressed data are expanded. Therefore, the number and scale of circuits required to convert a speech speed become large.

As a publicly known technology for converting a speech speed after decoding MPEG audio data, there is Japanese Patent Laid-open No. 9-73299.

SUMMARY OF THE INVENTION

It is an object of the present invention to provide a reproduction device, by which the speech speed of multimedia data can be converted with a simple configuration, and a method thereof.

The first data reproduction device of the present invention is intended to reproduce compressed multimedia data, including audio data. The device comprises extraction means for extracting a frame, which is the unit data of the audio data, conversion means for thinning out the frame of the audio data or repeatedly outputting the frame and reproduction means for decoding the frame of the audio data received from the conversion means and reproducing voice.

The second data reproduction device of the present invention is intended to reproduce multimedia data, including audio data, and the speech speed of compressed audio data can be converted and the audio data can be reproduced without decoding the compressed audio data. The device comprises extraction means for extracting a frame, which is the unit data of the audio data, setting means for setting the reproduce speed of the audio data, speed conversion means for thinning out the frame of the audio data or repeatedly outputting the frame and reproduce means for decoding the frames of the audio data received from the speed conversion means and reproducing voice.

The data reproduction method is intended to reproduce multimedia, including audio data, and the speech speed of compressed audio data can be converted and reproduced without decoding the compressed audio data. The method comprises the steps of (a) extracting a frame, which is the unit data of the audio data, (b) setting the reproduce speed of the audio data, (c) thinning out the frame of the audio data or repeatedly outputting the frame based on the reproduce speed set in step (b), and (d) decoding the frame of the audio data received after step (c) and reproducing voice.

According to the present invention, the speech speed of the compressed audio data can be converted without decoding and being left compressed. Therefore, the circuit scale required for a data reproduction device can be reduced, the speech speed of audio data can be converted and the data can be reproduced.

BRIEF DESCRIPTIONS OF THE DRAWINGS

DESCRIPTION OF THE PREFERRED EMBODIMENTS

Figure 1:
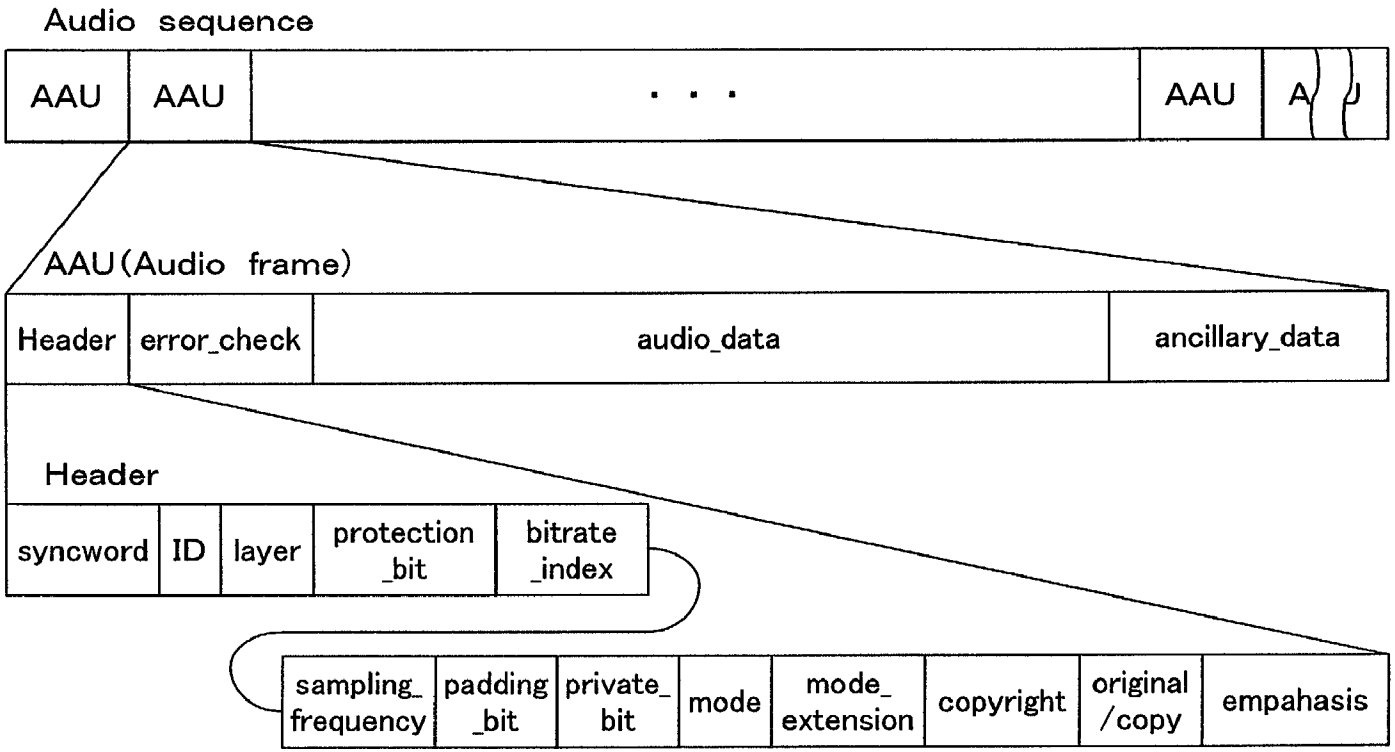
FIG. 1 PRIOR ART
FIG. 1 shows the format of MPEG audio data (No. 1).
Figure 2:
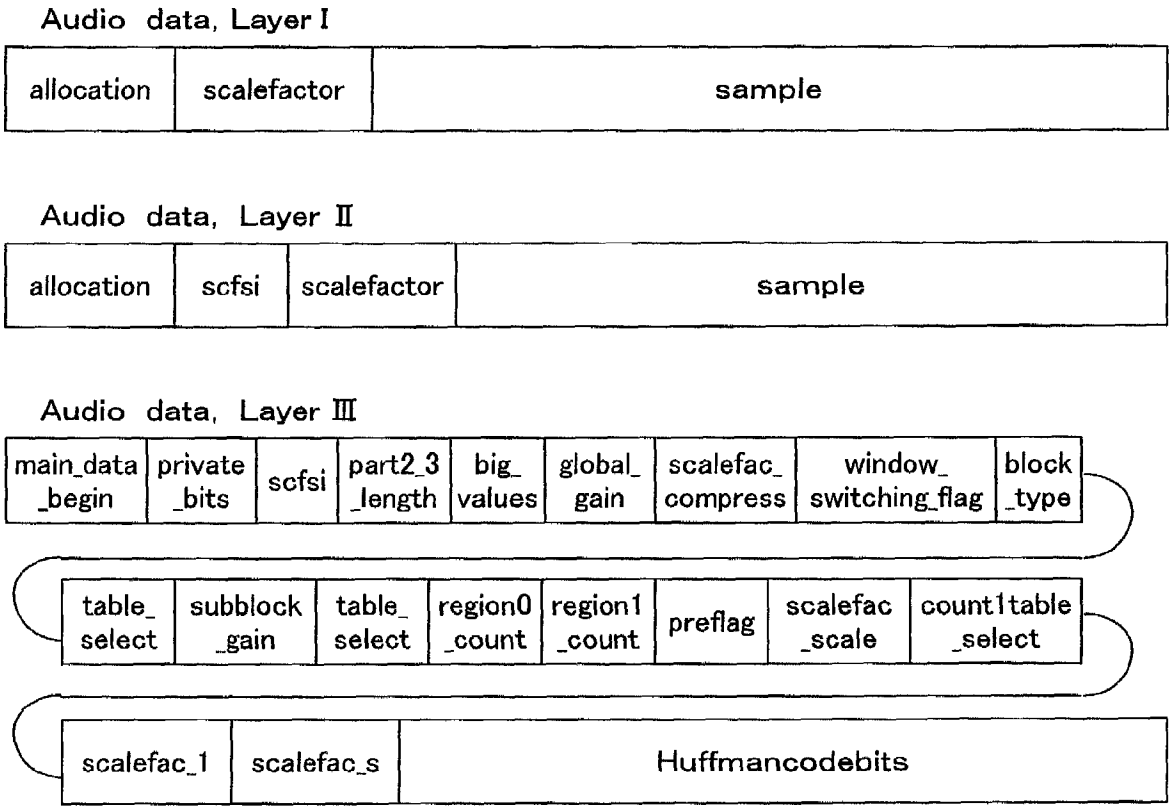
FIG. 2 PRIOR ART
FIG. 2 shows the format of MPEG audio data (No. 2).

In the preferred embodiment of the present invention, a frame called an "audio frame" is extracted from MPEG audio data, and a speech speed is increased by thinning out the frame according to prescribed rules or it is decreased by inserting the frame according to prescribed rules. An evaluation function is also calculated using a scale factor obtained from the extracted frame, and silent sections are also compressed by thinning out the frame according to prescribed rules. Furthermore, auditory incompatibility (noise, etc.) in a joint can be reduced by converting scale factors in frames immediately after and before a joint. The reproduction device comprises a data input unit, a MPEG data identification unit, a speech speed conversion unit for converting the speech speed by the method described above, an MPEG audio unit and an audio output unit.

The frame extraction conducted in the preferred embodiment of the present invention is described with reference to the configurations of the MPEG audio data reproduction devices shown in FIGS. 16 and 17.

A frame is extracted by detecting a syncword located at the head of a frame. Specifically, a bit string ranging from the head of the syncword of frame n until before the syncword of frame n+1 is read.

Alternatively, the bit rate, sampling frequency and padding bit can be extracted from an audio frame header consisting of 32 bits of bit string, including the syncword, the data length of one frame can be calculated according to the following equation and the a bit string ranging from the syncword until the data length can be read.

$$\{\text{frame size} \times \text{bit rate [bit/sec]} \div 8 \div \text{sampling frequency [Hz]}\} + \text{padding bit [byte]}$$

Since in speech speed conversion, it is important to make a listener not to feel incompatible when a reproduce speed is converted, the process is performed in the following steps.

Extraction of a basic cycle

Thinning-out and repetition of the basic cycle

Compression of silent parts

The cycle of a wave with audio cyclicity is called a "basic cycle", and the basic cycles of Japanese man and woman are 100 to 150 Hz and 250 to 300 Hz, respectively. To increase a speech speed, waves with cyclicity are extracted and thinned out, and to decrease the speed, the waves are extracted and repeated.

If the conventional speech speed conversion is applied to MPEG audio data, there are the following problems.

Restoration to a PCM format is required.

A real-time process requires exclusive hardware.

In an audio process, approximately 10 to 30 milliseconds are generally used as the process time unit. In MPEG audio data, time for one audio frame is approximately 20 milliseconds (in the case of layer II, 44.1 KHz and 1152 samples).

By using an audio frame instead of this basic cycle, a speech speed can be converted without the restoration.

To detect a silent section, conventionally, the strength of an acoustic pressure had to be evaluated. Strictly speaking, a silent section cannot be accurately detected without decoding. However, since a scale factor included in audio data is indicated by the reproduction scale factor of a wave, it has a characteristic close to an acoustic pressure. Therefore, in this preferred embodiment, the scale factor is used.

Figure 4:
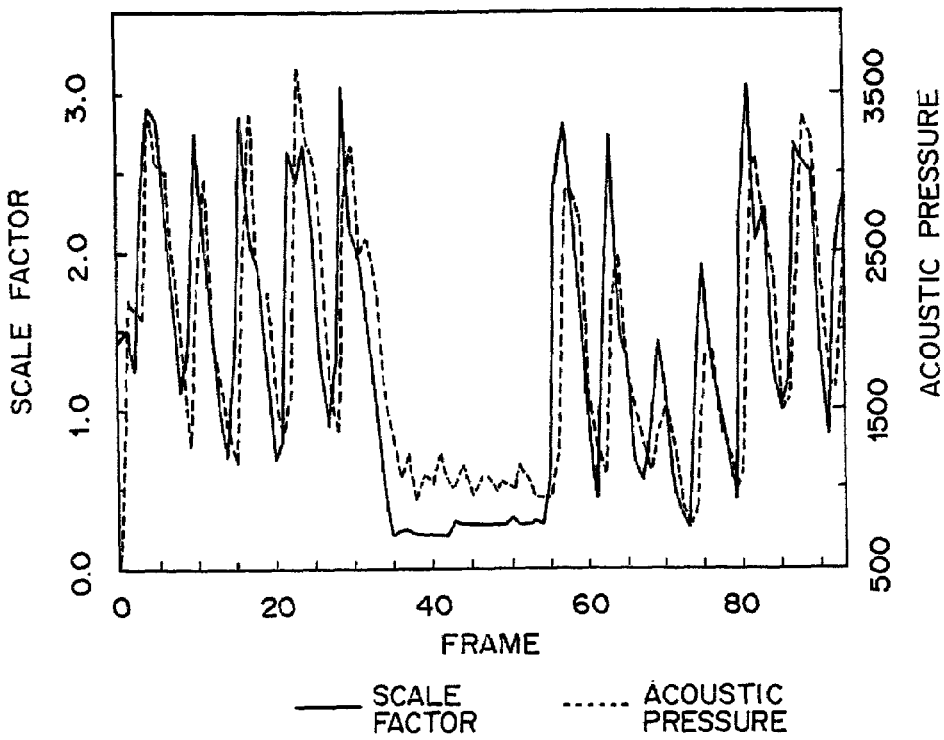
FIG. 4 shows the comparison between the scale factor of data obtained by compressing the same audio data with MPEG audio layer II and the acoustic pressure of non-compressed data.

FIG. 4 shows the comparison between the scale factor of data obtained by compressing the same audio data with MPEG audio layer II and the acoustic pressure of non-compressed data.

The vertical axis of a graph represents the average of scale factors or the section average of acoustic pressures in one frame (MPEG audio layer II equivalent: 1152 samples), and a horizontal axis represents time. The scale factor and acoustic pressure show very close shapes. In this example, the correlation coefficient is approximately 80% and a high correlation is indicated. Although it depends on the performance of an encoder, it is shown that the scale factor has a characteristic very close to the acoustic pressure.

Therefore, in this preferred embodiment, a silent section is detected by calculating an evaluation function from the scale factor. For an example of the evaluation function, the average value of scale factors in one frame can be used. Alternatively, an evaluation function can be set across several frames, it can be set using a scale factor for each sub-band or these functions can be combined.

However, if frames are jointed after simply thinning out each frame unit, auditory incompatibility is sometimes detected at a joint between frames. This incompatibility is caused due to the fact that the conversion of an acoustic pressure discontinuously becomes great or small. Therefore, in this preferred embodiment, this incompatibility is reduced by converting a part of scale factors in frames after and before a joint between frames.

For example, if a scale factor immediately before the joint is close to 0 and a scale factor immediately after the joint is close to a maximum value, a high frequency element, which is usually included in a joint is added and this element appears as auditory incompatibility of noise. In this case, the incompatibility can be reduced by converting the scale factors after and before the joint.

In the preferred embodiment of the present invention, since a speech speed is converted in units of frames called audio frames defined in the MPEG audio standard without decoding MPEG data, a circuit scale can be reduced and the speech speed can be converted with a simple configuration. By using a scale factor, a silent section can also be detected without obtaining an acoustic pressure by decoding and a speech speed can also be converted by deleting the silent section and allocating a sound section. Furthermore, by enabling a scale factor to be appropriately converted, auditory incompatibility in frames after and before a joint can be reduced.

Figure 5:
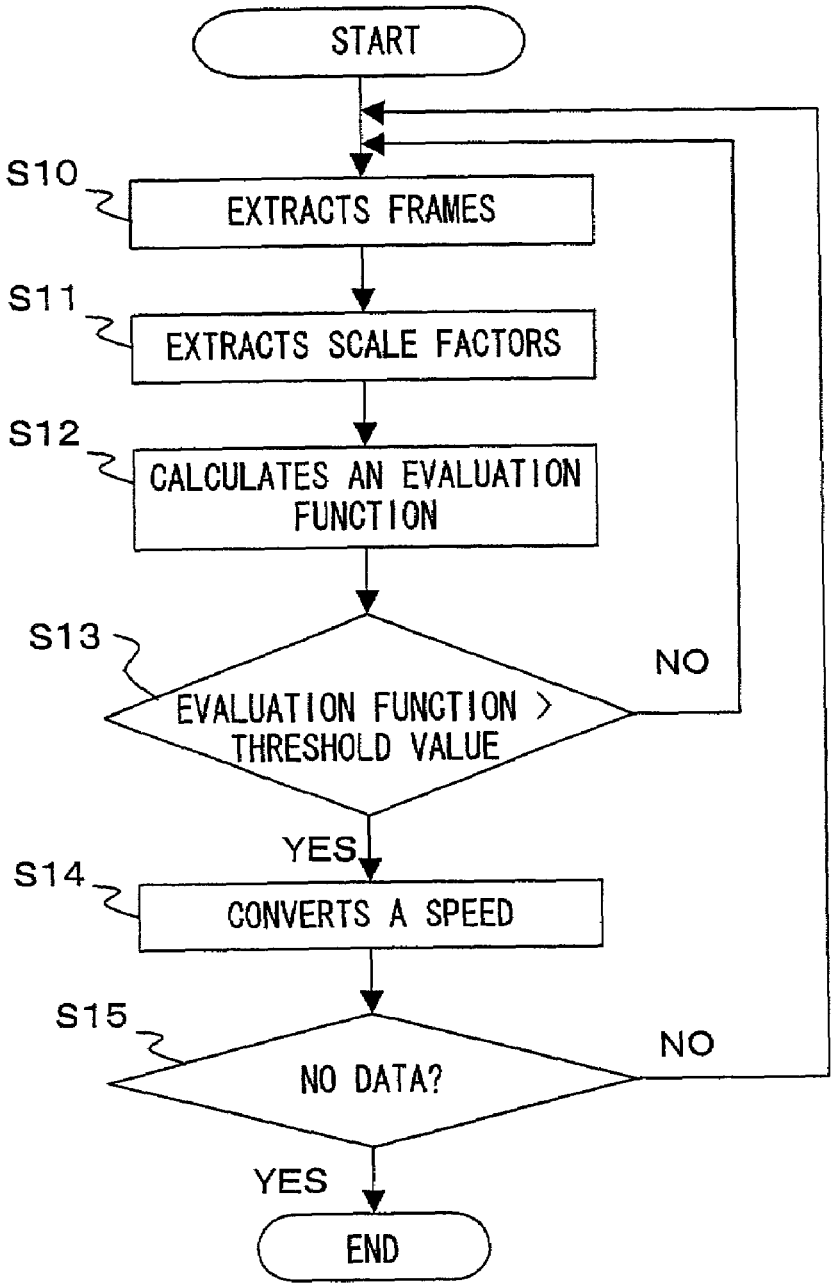
FIG. 5 is a basic flowchart showing the speech speed conversion process of the present invention.

FIG. 5 is a basic flowchart showing the speech speed conversion process of the present invention.

Figure 3:
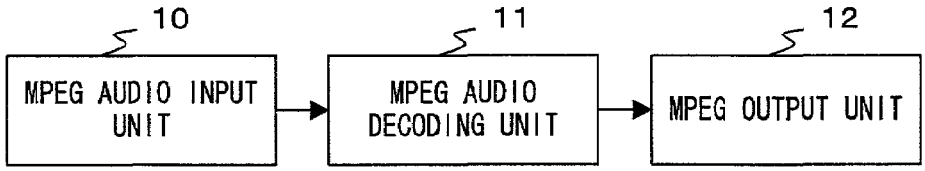
FIG. 3 PRIOR ART
FIG. 3 shows the basic configuration of the conventional MPEG audio reproduce device.

First, in step S10, a frame is extracted. A frame is extracted by detecting a syncword at the head of a frame. Specifically, a bit string ranging from the head of the syncword of frame n until immediately before the syncword of frame n+1 is read. Alternatively, a bit rate, a sampling frequency and a padding bit can be extracted from an audio frame header consisting of 32 bits of bit string, including a syncword, the data length of one frame can be calculated according to the equation described above and a bit string ranging from the syncword until the data length can be read. Since frame extraction is an indispensable process for the decoding of MPEG audio data, it can also be implemented simply by using a frame extraction function used in the MPEG audio decoding. If a frame is normally extracted, then a scale factor is extracted. As shown in FIG. 3, a scale factor is located at the bit position of each layer that is fixed in the head of MPEG audio data, a scale factor can be extracted by counting the number of bits from a syncword. Alternatively, since a scale factor extraction is also an indispensable process for the decoding of MPEG audio data like frame extraction, a scale factor extracted by the existing MPEG audio decoding process can be used.

Then, in step S12, an evaluation function can be calculated from the scale factor. For a simple example of the evaluation function, the average value of a scale factor in one frame can be used. Alternatively, an evaluation function can be set across several frames, it can be set from a scale factor for each sub-band or these evaluations can be combined.

Then, the calculation value of the evaluation function is compared with a predetermined threshold value. If the evaluation function value is larger than the threshold value, the frame is judged to be one in a sound section, and the flow proceeds to step S14. If the evaluation function value is equal to or less than the threshold value, the frame is judged to be one in a silent section and is neglected. Then, the flow returns to step S10. In this case, the threshold value can be fixed or variable.

In step S14, a speech speed is converted. It is assumed that the original speed of MPEG data is 1. If a required reproduction speed is larger than 1, data are compressed and outputted by thinning out a frame at specific intervals. For example, if frames are numbered 0, 1, 2, . . . , from the top and if a double speed is required, the data are decoded and reproduced by thinning out the frames into frames 0, 2, 4, . . . . If the required reproduction speed is less than 1, frames are repeatedly outputted at specific intervals. For example, if a half speed is required in the same example, the data are decoded and reproduced by arraying the frames in an order of frames 0, 0, 1, 1, 2, 2, . . . . When the MPEG data are decoded and outputted in this way, a listener can listen as if the data were reproduced at a desired speed.

Then, if in step S14 the speed conversion of a specific frame is completed, in step S15 it is judged whether there are data to be processed. If there are data, the flow returns to step S10 and a subsequent frame is processed. If there are no data, the process is terminated.

Figure 6:
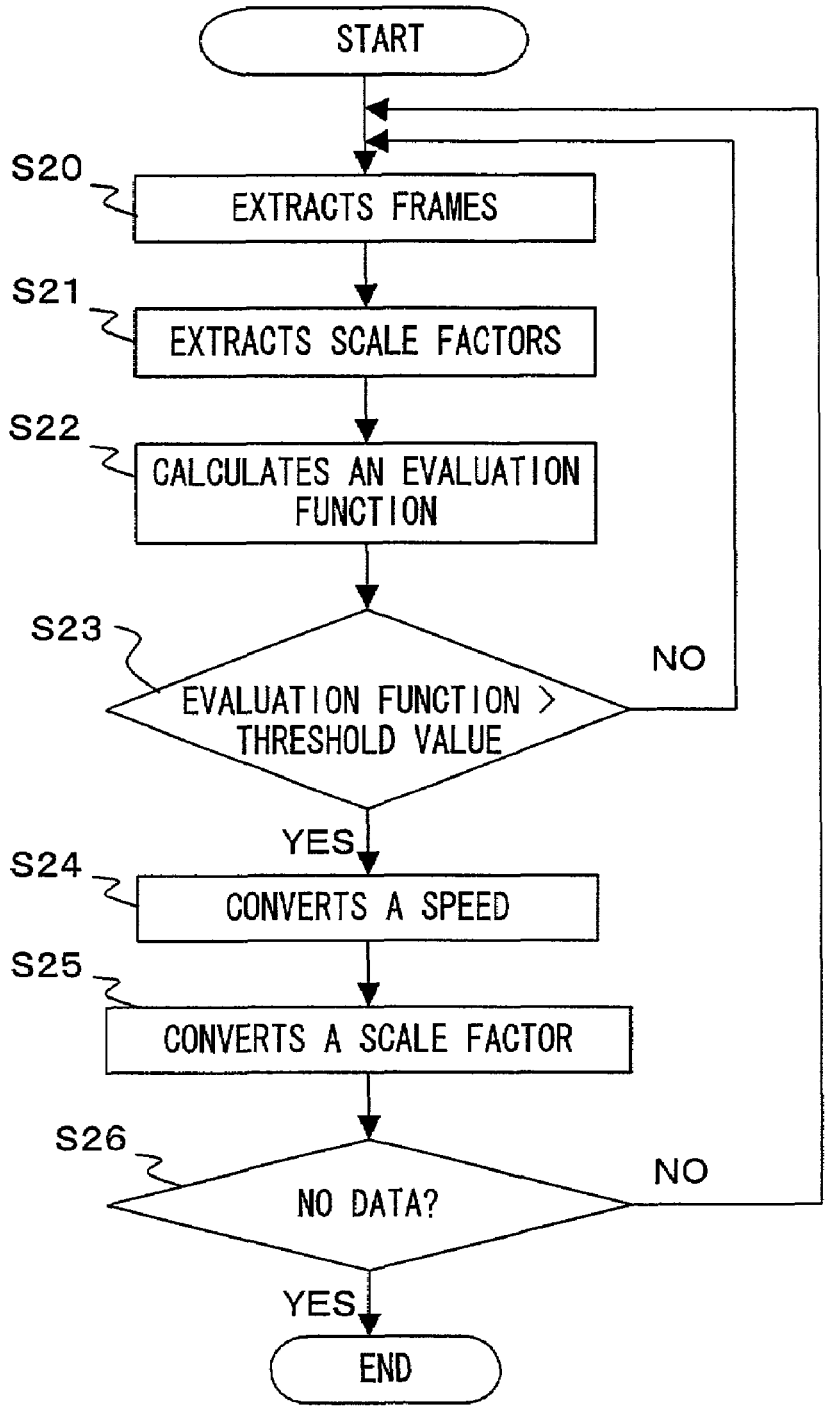
FIG. 6 is another basic flowchart showing the speech speed conversion process of the present invention.

FIG. 6 is a basic flowchart showing another speech speed conversion process of the present invention.

As in the case of FIG. 6, in step S20, a frame is extracted and in step S21, a scale factor is extracted. Then, in step S22, an evaluation function is calculated and in step S23, the evaluation function value is compared with a threshold value. If in step S23 it is judged that the evaluation function value is larger than the threshold value, the frame is judged to be a sound section frame and the flow proceeds to S24. If in step S23 it is judged that the evaluation function value is less than the threshold value, the frame is judged to be a silent section frame. Then, the flow returns to step S20 and a subsequent frame is processed.

In step S24, a speech speed is converted as described with reference to FIG. 5, and in step S25, a scale factor is converted in order to suppress noise in a joint between frames. Then, in step S26 it is judged whether there are subsequent data. If there are data, the flow returns to step S20. If there are no data, the process is terminated. In the scale factor conversion process, an immediately previous frame is stored, and scale factors after and before the joint between frames are adjusted and outputted.

Figure 7:
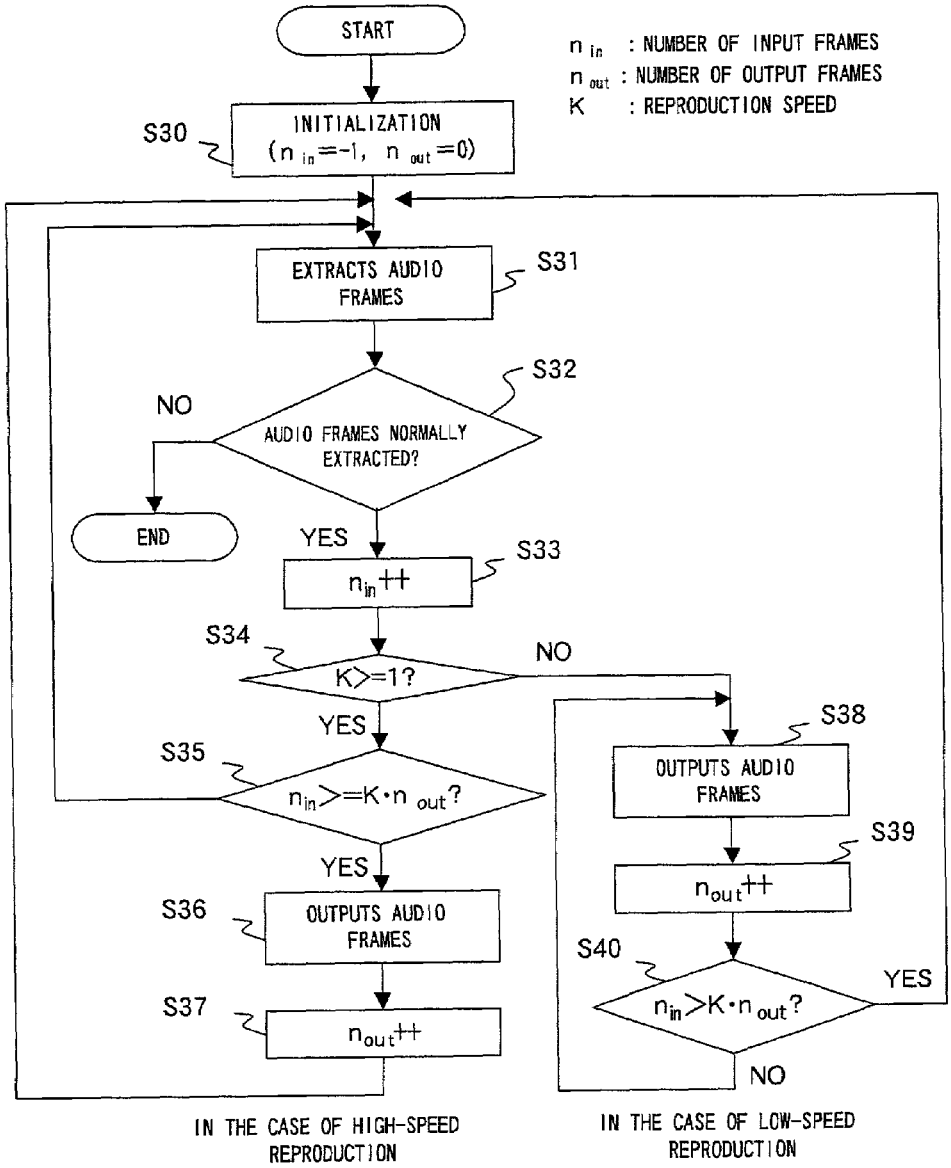
FIG. 7 is a detailed flowchart showing the reproduction speed conversion process.

FIG. 7 is a detailed flowchart showing the reproduction speed conversion process.

In FIG. 7 it is assumed that $n_{in}$, $n_{out}$ and K are the number of input frames, the number of output frames and a reproduction speed, respectively.

First, in step S30, initialization is conducted. Specifically, $n_{in}$ and $n_{out}$ are set to −1 and 0, respectively. Then, in step S31, an audio frame is extracted. Since as described earlier, this process can be implemented using the existing technology, no detailed description is not given here. Then, in step S32 it is judged whether the audio frame is normally extracted. If in step S32 it is judged that the audio frame is abnormally extracted, the process is terminated. If in step S32 it is judged that the audio frame is normally extracted, the flow proceeds to step S33.

In step S33, $n_{in}$ being the number of input frames, is incremented by one. Then, in step S34 it is judged whether reproduction speed K is 1 or more. This reproduction speed is generally set by the user of a reproduction device. If in step S34 it is judged that the reproduction speed is 1 or more, it is judged whether K (reproduction speed) times of the number of output frames $n_{out}$ is larger than the number of input frames $n_{in}$ (step S35). Specifically, it is judged whether K (reproduction speed) times of the number of output frames outputted by thinning out input frames is less than the number of the input frames $n_{in}$. If the judgment in step S35 is no, the flow returns to 31. If the judgment in step S35 is yes, the flow proceeds to step S36.

In step S36, the audio frame is outputted. Then, in step S37, the number of output frames $n_{out}$ is incremented by one and the flow returns to step S31.

If K in FIG. 7 is 1 or more, the data are thinned out by repeating the process of an audio frame. In the case of a triple speed, the data are thinned out into frames 0, 3, 6, . . . . In the case of one and a half speed, an equation 1.5×N (integer)=M (integer) is calculated, the M-th frame is located at the (N+1)-th position and an appropriate frame is inserted between the frames arrayed in this way. Specifically, in the case of one and a half speed, frames are arrayed in an order of frames 0, 1, 3, 4, 6, . . . , or 0, 2, 3, 5, 6, . . . . If in step S34 reproduction speed K is less than 1, in step S38 the audio frames are outputted. In this case, a reproduction speed of less than 1 can be implemented by outputting the audio frames as shown in the flowchart, for example, by outputting frames in an order of frames 0, 0, 1, 1, 2, 2, . . . , in the case of a half speed, or in an order of frames 0, 0, 0, 1, 1, 1, 2, 2, 2, . . . , in the case of an one-third speed, etc.

Then, in step S39, the number of output frames $n_{out}$ is incremented by one, and in step S40 it is judged whether the number of input frames $n_{in}$ is less than K (reproduction speed) times of the number of output frames $n_{out}$. If the judgment in step S40 is yes, the flow returns to step S31. If the judgment in step S40 is no, the flow returns to step S38 and the same frame is repeatedly outputted.

A reproduction speed is converted by repeating the processes described above.

Figure 8:
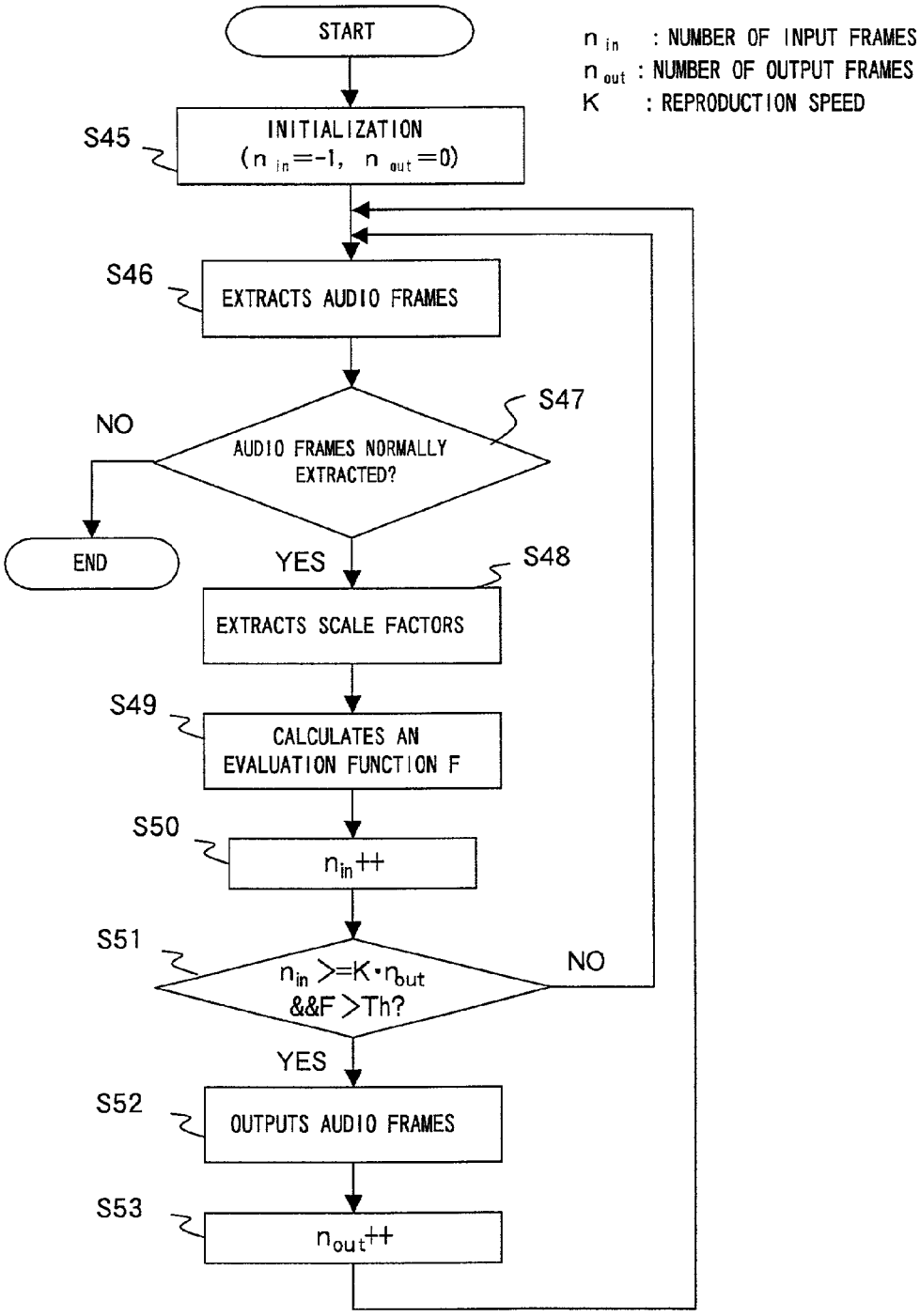
FIG. 8 is a detailed flowchart showing a process, including a reproduction speed conversion process and a silent part elimination process.

FIG. 8 is a detailed flowchart showing a process, including the reproduction speed conversion process and silent part elimination process.

First, in step S45, $n_{in}$ and $n_{out}$ are initialized to −1 and 0, respectively. Then, in step S46, an audio frame is extracted. In step S47 it is judged whether the audio frame is normally extracted. If the frame is abnormally extracted, the process is terminated. If the frame is normally extracted, in step S48, a scale factor is extracted. Since as described earlier, scale factor extraction can be implemented using the existing technology, the detailed description is omitted here. Then, in step S49, evaluation function F (for example, the total of one frame of scale factors) is calculated from the extracted scale factor. Then, in step S50, the number of input frames $n_{in}$ is incremented by one and the flow proceeds to step S51. In step S51 it is judged whether $n_{in} \geqq K \cdot n_{out}$ and simultaneously F>Th (threshold value). If the judgment in step S51 is no, the flow returns to S46. If the judgment in step S51 is yes, in step S52, the audio frame is outputted and in step S53, the number of output frames $n_{out}$ is incremented by one. Then, the flow proceeds to S46.

In this case, the meaning of the judgment expression $n_{in} \geqq K \cdot n_{out}$ in step S51 is the same as that described with reference to FIG. 7. F>Th is also as described with reference to the basic flowchart described earlier.

Figure 9:
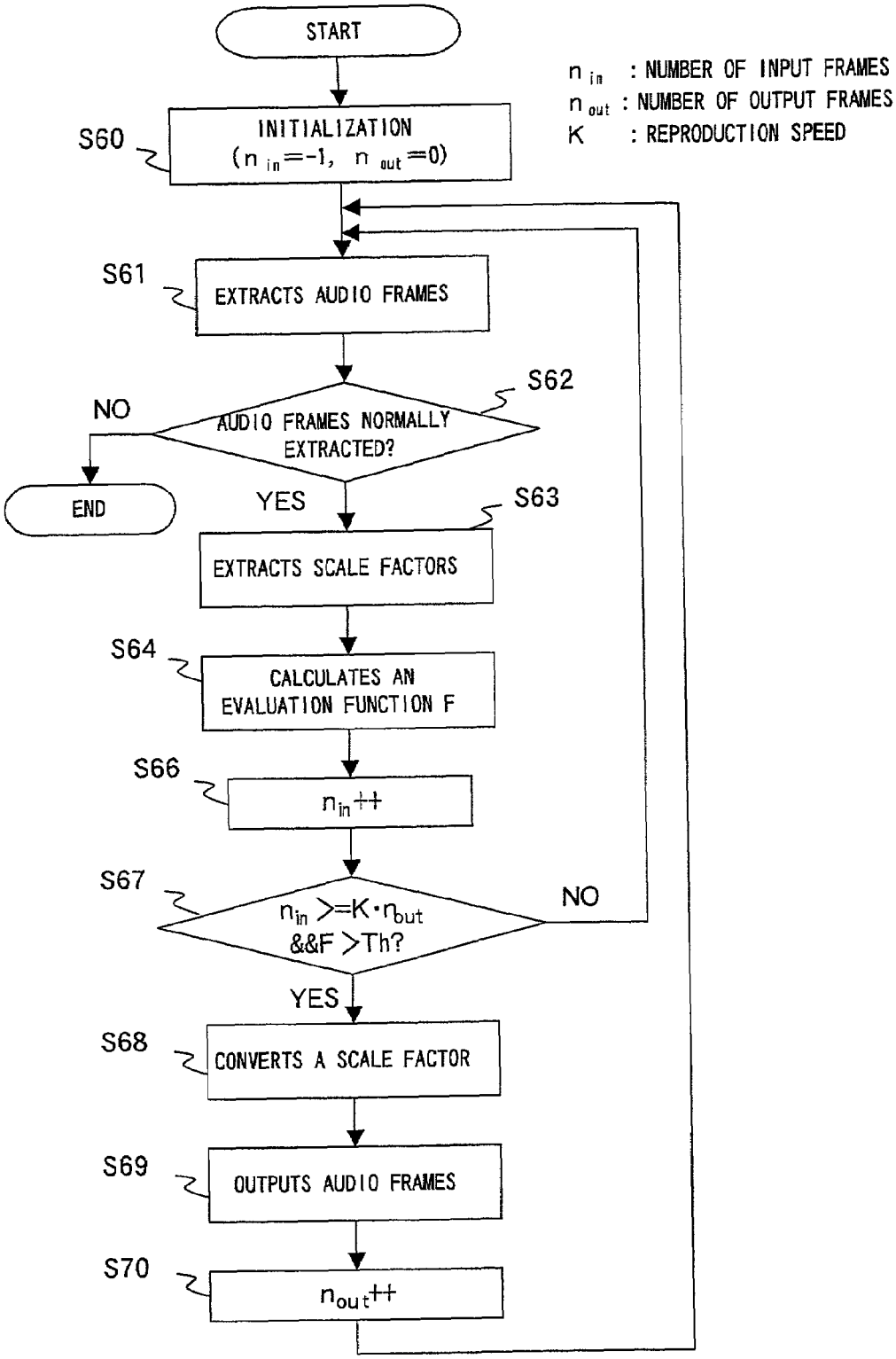
FIG. 9 is a flowchart showing a noise reduction process.

FIG. 9 is a flowchart showing a noise reduction process.

First, in step S60, initialization is conducted by setting $n_{in}$ and $n_{out}$ to −1 and 0, respectively. Then, in step S61, an audio frame is extracted and in step S62 it is judged whether the audio frame is normally extracted. If the audio frames are abnormally extracted, the process is terminated. If the audio frame is normally extracted, the flow proceeds to step 563.

Then, in step 563, a scale factor is extracted, and in step S64, evaluation function F is calculated. Then, in step S66, the number of input frames $n_{in}$ is incremented by one, and in step S67 it is judged whether $n_{in} \geqq K \cdot n_{out}$ and simultaneously F>Th. If the judgment in step S67 is no, the flow returns to step S61. If the judgment in step S67 is yes, in step S68 the scale factor is converted.

Then, in step S69, the audio frame is outputted and in step S70, the number of output frames $n_{out}$ is incremented by one. Then, the flow returns to step S61.

Figure 10:
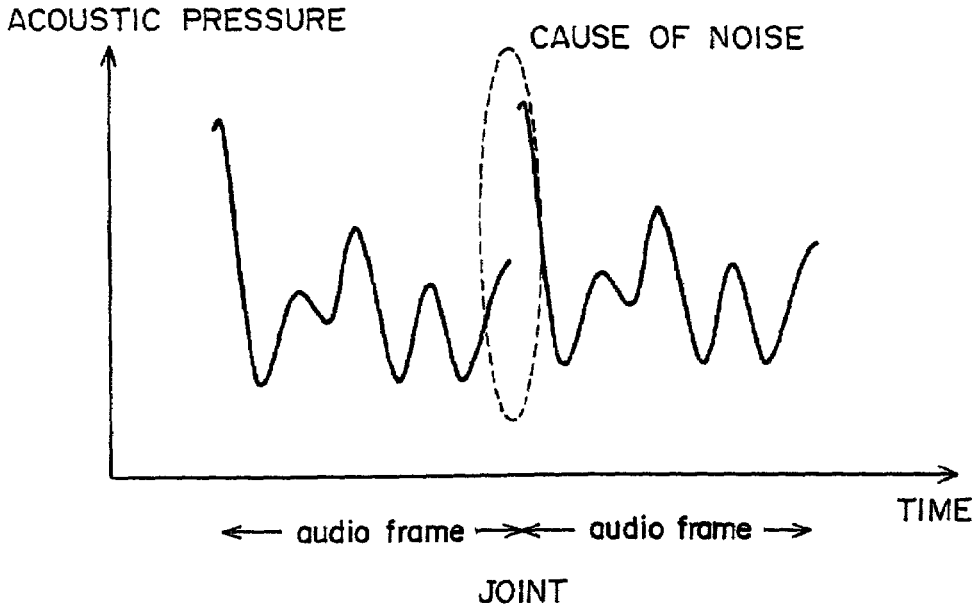
FIG. 10 shows the scale factor conversion process shown in FIG. 9 (No. 1).
Figure 11:
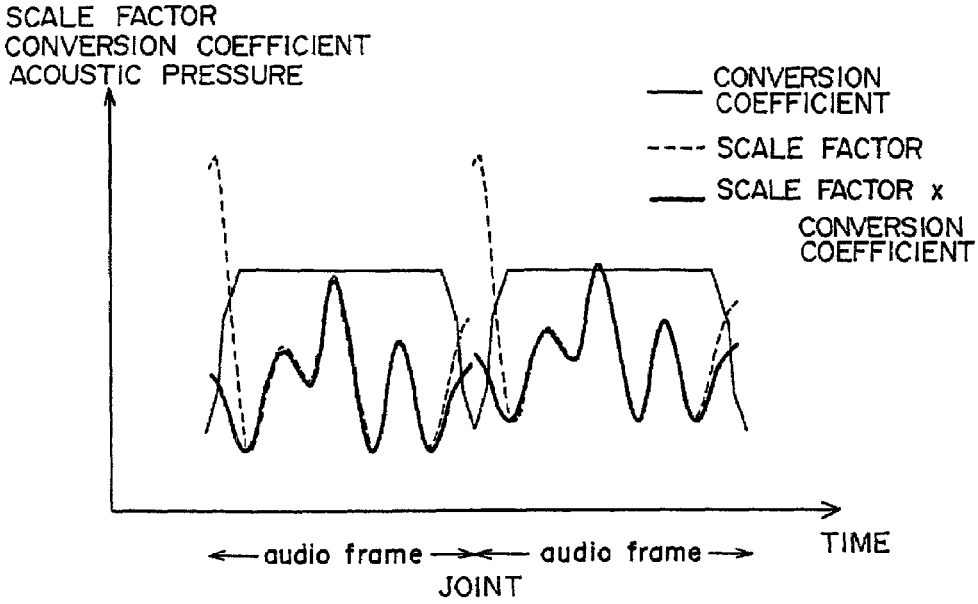
FIG. 11 shows the scale factor conversion process shown in FIG. 9 (No. 2).

FIGS. 10 and 11 show the scale factor conversion process shown in FIG. 9.

As shown in FIG. 10, if audio frames are thinned out and transmitted, the discontinuous fluctuations of an acoustic pressure occur at a joint between audio frames. Since such discontinuity is heard as noise to a user who listens to voice, a very annoying sound is heard, if data are quickly fed.

Therefore, as shown in FIG. 11, voice is reproduced by multiplying the scale factor by a conversion coefficient such that a coefficient value may become small in the vicinity of the boundary of audio frames. In this way, as shown by thick lines in FIG. 11, the discontinuous jump of the acoustic pressure in the vicinity of a joint between frames can be mitigated. Therefore, the noise becomes small for the user who listens to the reproduction sound, and even if data are quickly fed, it ceases to be annoying.

Figure 12:
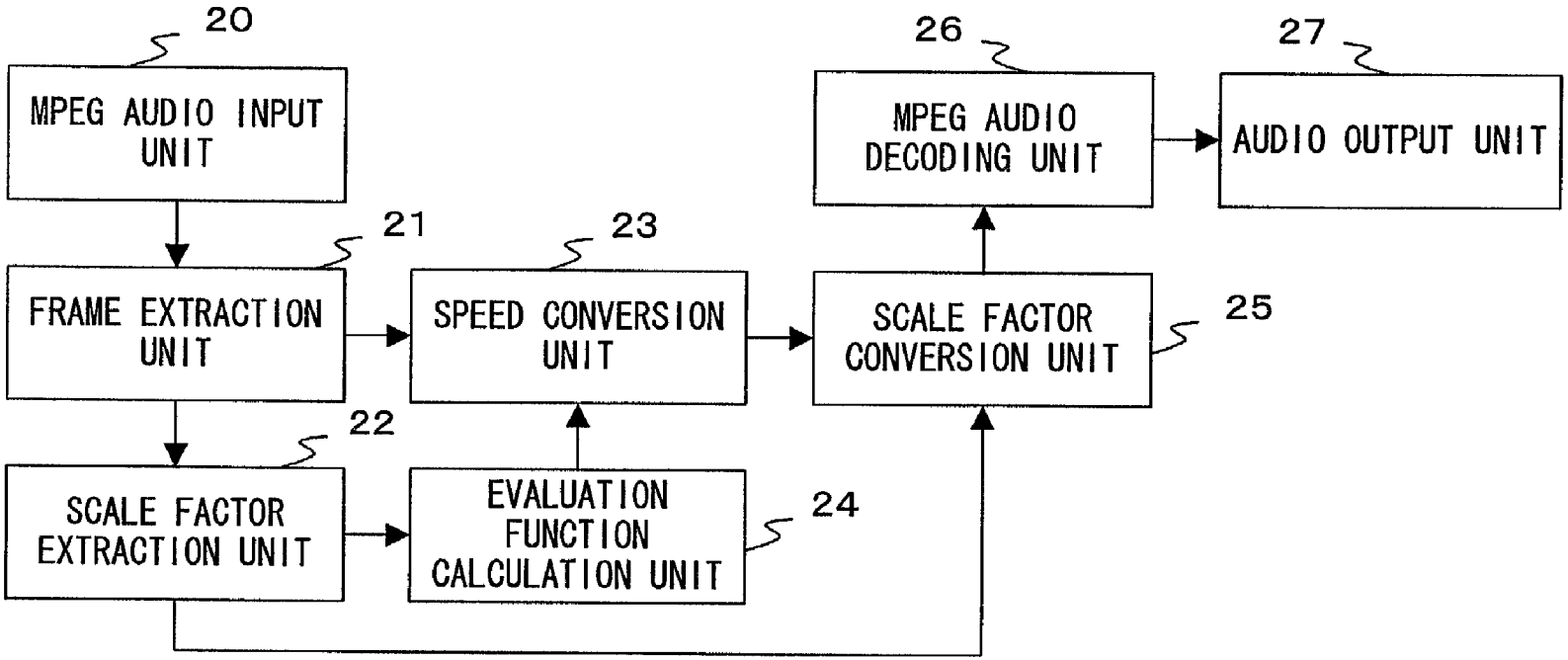
FIG. 12 shows one configuration of the MPEG audio data reproduction device, to which the speech speed conversion of the present invention is applied.

FIG. 12 shows one configuration of the MPEG audio data reproduction device, to which the speech speed conversion of the present invention is applied.

This configuration can be obtained by adding a frame extraction unit 21, an evaluation function calculation unit 24, a speed conversion unit 23 and a scale conversion unit 25 to the conventional MPEG audio reproduce device shown in FIG. 3. The frame extraction unit 21 is explicitly shown in FIG. 12, although it is included in the MPEG audio decoding unit 11 and is not explicitly shown in FIG. 3.

The frame extraction unit 21 has a function to extract a frame also called the audio frame of MPEG audio data, and outputs frame data to both the scale factor extraction unit 22 and speed conversion unit 23. Then, the scale factor extraction unit 22 extracts a scale factor from the frame and outputs the scale factor to the evaluation function calculation unit 24. The speed conversion unit 24 thins out or repeats frames. Simultaneously, the speed conversion unit 24 deletes the data amount of silent sections using an evaluation function and outputs the data to the scale factor conversion unit 25. Then, the scale factor conversion unit 25 converts scale factors after and before frames connected by the speed conversion unit 23 and outputs the data to the MPEG audio decoding unit 26.

This configuration can be obtained by adding only speed conversion circuits 22, 23, 24 and 25 to the popular MPEG audio reproduction device shown in FIG. 3, and can be easily provided with a speech speed conversion function.

Figure 13:
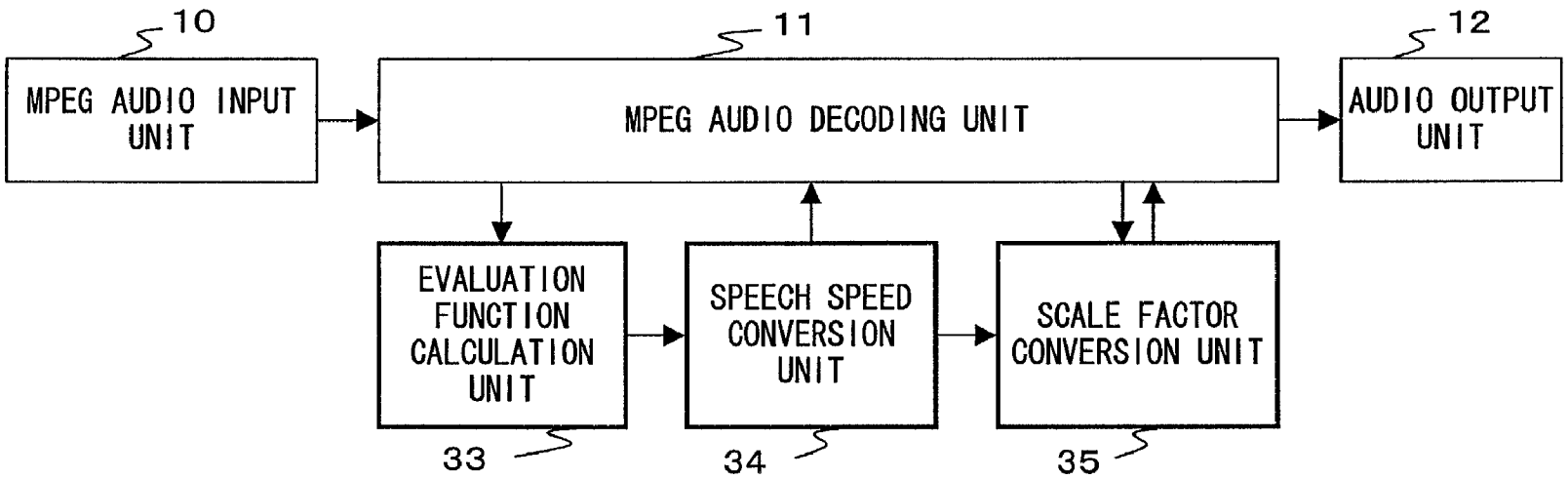
FIG. 13 shows another configuration of the MPEG data reproduce device, to which the speech speed conversion of the present invention is applied.

FIG. 13 shows another configuration of the MPEG data reproduction device, to which the speech speed conversion is applied.

The configuration shown in FIG. 13 can be obtained by adding an evaluation function calculation unit 33, a speech speed conversion unit 34 and a scale factor conversion unit 35 to the popular MPEG audio reproduction device shown in FIG. 3. An MPEG audio decoding unit 31 already has a frame extraction function and a scale extraction function. This means that the MPEG audio decoding unit 31 includes apart of a process required by the speech speed conversion method in the preferred embodiment of the present invention. Therefore, in this case, circuit scale can be reduced by using the frame extraction and scale factor conversion functions of the MPEG audio decoding unit 31.

The frame and scale factor that are extracted by the MPEG audio decoding unit 31 are transmitted to the evaluation function calculation unit 33, and the evaluation function calculation unit 33 calculates an evaluation function. The evaluation function value and frame are transmitted to the speech speed conversion unit 34 and are used for the thinning-out and repetition of frames. Then, the speed-converted frame and scale factor are transmitted to the MPEG audio decoding unit 11. The scale factor is also transmitted from the MPEG audio decoding unit 12 to the scale factor conversion unit 35, and the scale factor conversion unit 35 converts the scale factor. The converted scale factor is inputted to the MPEG audio decoding unit 11. The MPEG audio decoding unit 11 decodes MPEG audio data consisting of audio frames from the speed-converted frame and converted scale factor and transmits the decoded data to the audio output unit 12. In this way, speed-converted voice is outputted from the audio output unit 12.

Figure 14:
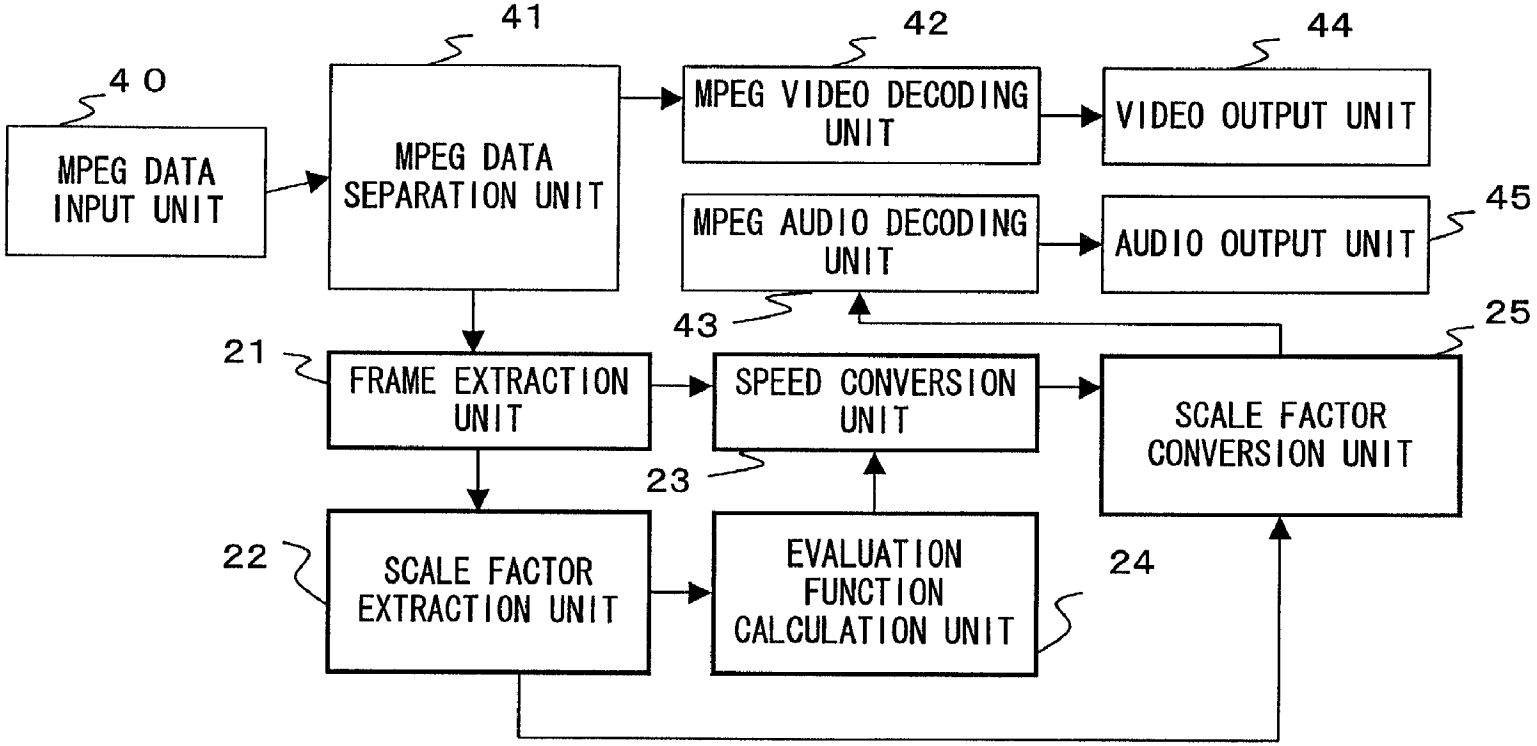
FIG. 14 shows the configuration of another preferred embodiment of the present invention.

FIG. 14 shows the configuration of another preferred embodiment of the present invention.

In FIG. 14, the same constituent elements as those used in FIG. 12 have the same reference numbers as used in FIG. 12 and the descriptions are omitted here.

FIG. 14 shows the configuration of a MPEG data reproduction device, to which speech speed conversion is applied. This configuration can be obtained by replacing the MPEG audio decoding unit of the conventional MPEG data reproduction device consisting of constituent elements 40, 41, 42, 43, 44 and 45 with the MPEG audio data reproduction unit excluding the MPEG audio input unit and audio output unit. Therefore, the same advantages as those of the preferred embodiment are available.

The configuration shown in FIG. 14 is for the case where MPEG data include not only audio data, but also video data.

First, if MPEG data are inputted from a MPEG data input 40, a MPEG data separation unit breaks down the MPEG data into MPEG video data and MPEG audio data. The MPEG video data and MPEG audio data are inputted to a MPEG video decoding unit 42 and the frame extraction unit 21, respectively. The MPEG video data are decoded by the MPEG video decoding unit 42 and are outputted from a video output unit 44.

The MPEG audio data are processed in the same way as described with reference to FIG. 12, are finally decoded by the MPEG audio decoding unit 43 and are outputted from an audio output unit 45.

Figure 15:
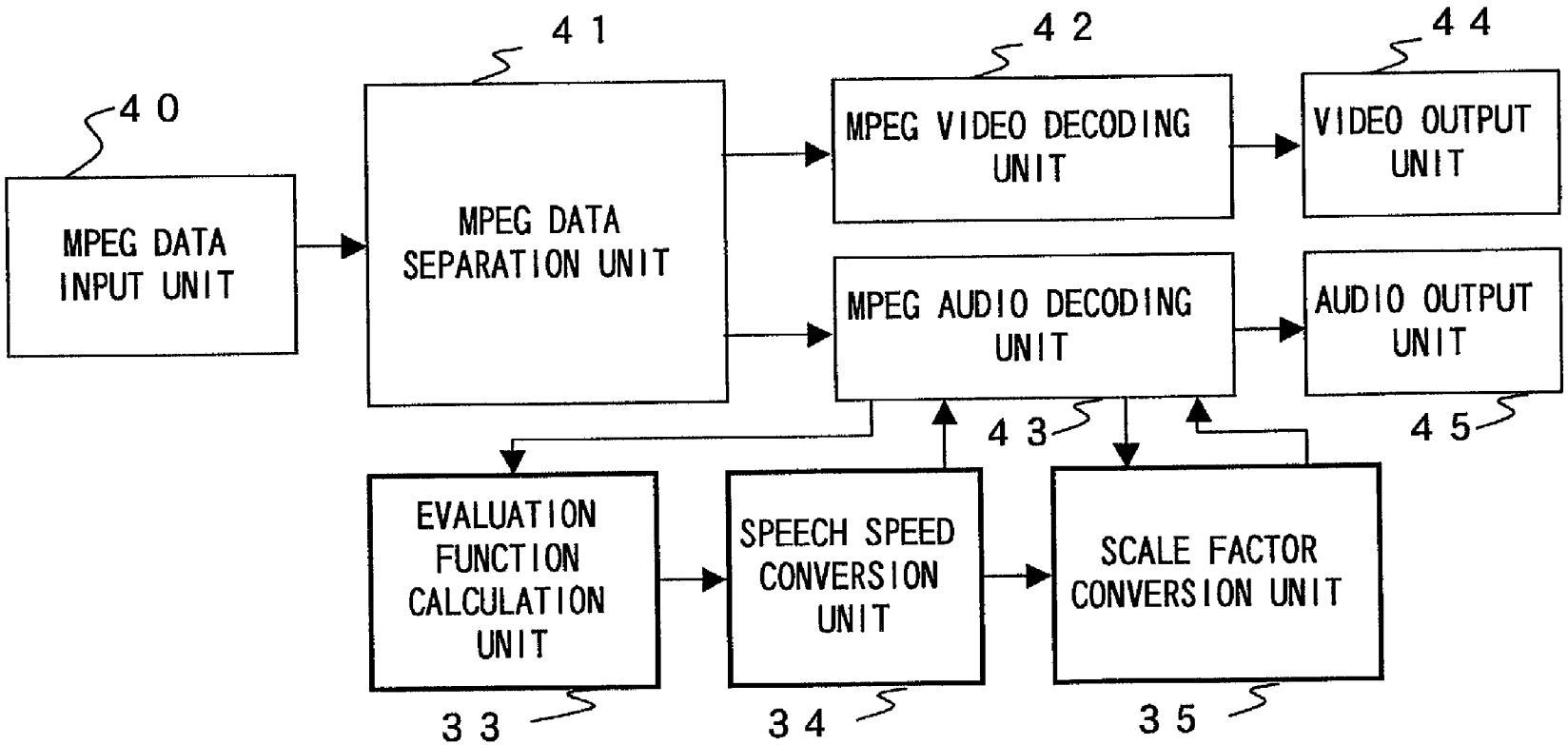
FIG. 15 shows one configuration of the MPEG data reproduction device, to which the speech speed conversion in another preferred embodiment of the present invention is applied.

FIG. 15 shows one configuration of the MPEG data reproduction device, to which speech speed conversion being another preferred embodiment of the present invention, is applied.

In FIG. 15, the same constituent elements as those of FIGS. 13 and 14 have the same reference numbers as those of FIGS. 13 and 14, and the descriptions are omitted here.

The configuration shown in FIG. 15 can be obtained by replacing the MPEG audio decoding unit of the conventional MPEG data reproduction device with the MPEG audio data reproduction device shown in FIG. 13, excluding the MPEG audio input unit and audio output unit. Therefore, the same advantages as those of the configuration shown in FIG. 13 are available.

Specifically, the MPEG audio decoding unit 43 extracts a frame and a scale factor from the MPEG audio data separated by the MPEG data separation unit 41, these results are inputted to the evaluation function calculation unit 33 and scale factor conversion unit 35, respectively, and the speech speed of the MPEG audio data is converted by the process described above.

Figure 16:
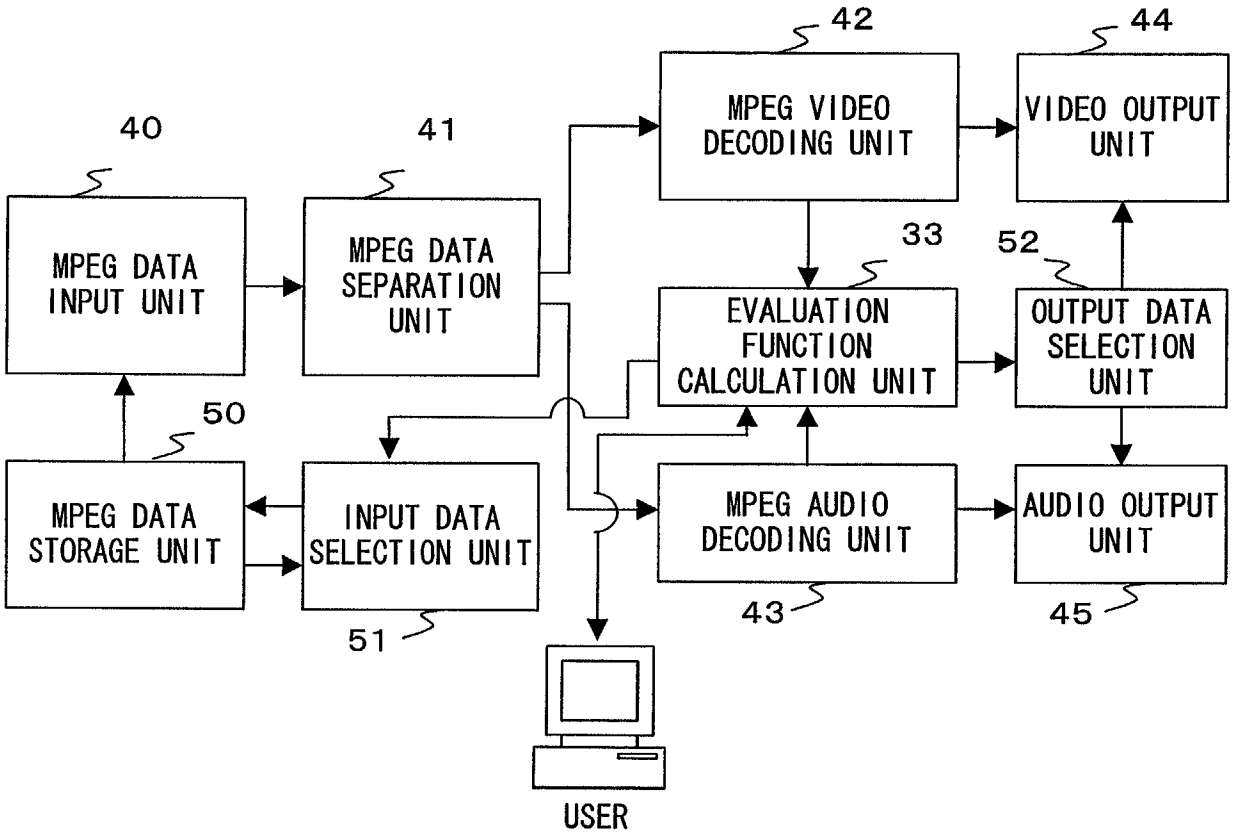
FIG. 16 shows the configuration of the MPEG data reproduction device in another preferred embodiment of the present invention.

FIG. 16 shows the configuration of the MPEG data reproduction device, which is another preferred embodiment of the present invention.

In FIG. 16, the same constituent elements as those of FIG. 15 have the same reference numbers as those of FIG. 15.

The configuration shown in FIG. 16 can be obtained by adding the evaluation function calculation unit 33, a data storage unit 50, an input data selection unit 51 and an output data selection unit 52 to the conventional MPEG data reproduction device. In particular, although only the process of MPEG audio data is independently considered in the configuration described above, the respective speed of both video data and audio data are converted in FIG. 16.

In this configuration, the evaluation function calculation unit 33 obtains a variety of parameters from the MPEG audio decoding unit 43 or MPEG video decoding unit 42, and calculates an evaluation function. The data storage unit 50 stores MPEG data. The input data selection unit 51 selects both an evaluation function and MPEG data that is inputted from the MPEG data storage unit 50 according to prescribed rules. The output data selection unit 52 selects both the evaluation function and data that are outputted according to prescribed rules.

A reproduction speed instruction from a user is inputted to the evaluation function calculation unit 33 and the reproduction speed information is reported to the input data selection unit 51.

As the parameter of an evaluation function, for example, parameters for speech speed conversion reproduction, such as speed, a scale factor, an audio frame count, etc., information obtained from voice, such as acoustic pressure, speech, etc., information obtained from a picture, such as a video frame count, a frame rate, color information, a discrete cosine conversion DC element, motion vector, scene change, a sub-title, etc., are effective. Since a relatively large circuit scale of frame memory and a video calculation circuit leads to cost increase, out of these, information obtained without decoding, such as a video frame count, a frame rate, a discrete cosine conversion DC element, motion vector can also be used for the parameter of the evaluation function instead of them. If the MPEG video decoding unit 42 is provided with a scene change detection function, a digest picture, the speech speed of which is converted without the loss of a scene in a silent section, can also be outputted by combining the function with the speech speed conversion function in the preferred embodiment of the present invention, specifically by calculating an evaluation function using a scene change frame, a scale factor and reproduction speed.

At the time of normal reproduction, MPEG data are consecutively read from the MPEG data storage unit 50. Therefore, if a data transfer rate, in which reproduction speed exceeds the upper limit, is calculated, reproduction is delayed. Therefore, in this case, the input data selection unit 51 skips in advance MPEG data unnecessary to be read, based on an evaluation function. In other words, the input data selection unit 51 discontinuously determines addresses to be read. Specifically, the input data selection unit 51 determines a video frame and an audio frame to be reproduced by the evaluation function and calculates the address of MPEG data to be reproduced. A packet, including audio data or a packet, including video data is judged by a packet header in the MPEG data. MPEG audio data can be accessed in units of frames and the address can be easily determined since the data length of a frame is constant in layers I and II. MPEG video data are accessed in units of GOPs, each of which is an aggregate of a plurality of frames.

In this case, according to the specification of MPEG data, MPEG audio data can be accessed in units of frames, but MPEG video data can be accessed in GOPs, each of which is an aggregate of a plurality of frames. However, there are frames unnecessary to be outputted depending on an evaluation function. Therefore, in such a case, the output data selection unit 52 determines a frame to be outputted, based on the evaluation function. The output data selection unit 52 also adjusts the synchronization between a video frame and an audio frame.

In the case of a high reproduction speed, since a human being cannot sensitively recognize synchronization between voice and a picture, strict synchronization is considered to be unnecessary. Therefore, the picture and voice of output data are selected in units of GOPs and audio frames, respectively, in such a way that the picture and voice can be synchronized as a whole.

Figure 17:
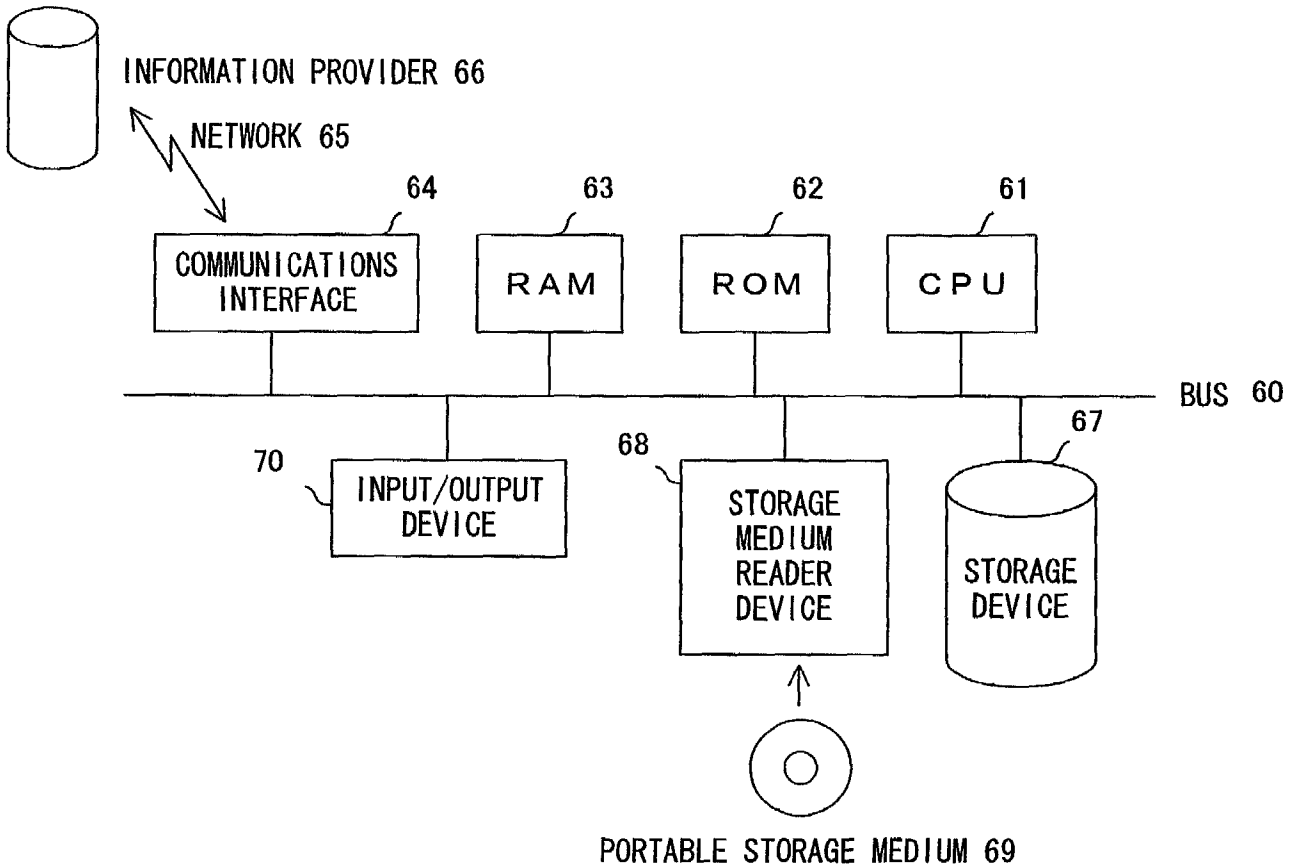
FIG. 17 shows one hardware configuration of a device required when the preferred embodiment of the present invention is implemented by a software program.

FIG. 17 shows one hardware configuration of a device required when the preferred embodiment of the present invention is implemented by a program.

A CPU 61 is connected to a ROM 62, a RAM 63, a communications interface 64, a storage device 67, a storage medium reader device 68 and an input/output device 70 via a bus 60.

The ROM 63 stores BIOS, etc., and CPU61's executing this BIOS enables a user to input instructions to the CPU 61 from the input/output device 70 and the calculation result of the CPU 61 can be presented to the user. The input/output device is composed of a display, a mouse, a keyboard, etc.

A program for implementing MPEG data reproduction following the speech speed conversion in the preferred embodiment of the present invention, can be stored in the ROM 62, RAM 63, storage device 67 or portable storage medium 69. If the program is stored in the ROM 62 or RAM 63, the CPU 61 directly executes the program. If the program is stored in the storage device 67 or portable storage medium 69, the storage device 67 directly inputs the program to the RAM 63 via a bus 60 or the storage medium reader device 68 reads the program stored in the portable storage medium 69 and stores the program in the RAM 63 via a bus 60. In this way, the CPU 61 can execute the program.

The storage device 67 is a hard disk, etc., and the portable storage medium 69 is a CD-ROM, a floppy disk, a DVD, etc.

This device can also comprise a communications interface 64. In this case, the database of an information provider 66 can be accessed via a network 65 and the program can be downloaded and used. Alternatively, if the network 65 is a LAN, the program can be executed in such a network environment.

As described so far, according to the present invention, by processing MPEG data in units of frames, each of which is defined in the MPEG audio standard, speech speed can be converted without decoding the MPEG data. By using a scale factor, silent sections can be compressed and speech speed can be converted without decoding the MPEG data.

By converting scale factors after and before a joint between frames, auditory incompatibility at the joint between frames can be reduced and this greatly contributes to the performance improvement of the MPEG data reproduce method and MPEG data reproduce device.

What is claimed is:

1. A data reproduction device for reproducing compressed multimedia data, including audio data which are MPEG audio data and also converting reproduction speed without decoding compressed audio data, comprising:

an extraction unit extracting a frame, which is unit data of the audio data;

a setting unit setting a reproduction speed of the audio data;

a scale factor extraction unit extracting a scale factor included in the frame;

a calculation unit calculating an evaluation function from the extracted scale factor, to thereby provide a calculation result;

a speed conversion unit comparing the calculation result of the calculation unit with a prescribed threshold value, judging to be a sound section frame if the calculation result is larger than the threshold value and, if a sound section frame is judged, speed converting the extracted frame by thinning out the extracted frame or repeatedly outputting the extracted frame;

a decoding unit decoding the speed converted frame; and a reproduction unit reproducing audible sound represented by the audio data from the decoded frame.

2. The data reproduction device according to claim 1, wherein said calculation unit calculates the evaluation function based on a plurality of scale factors included in the frame.

3. The data reproduction device according to claim 1, further comprising:

a scale factor conversion unit generating a scale factor conversion coefficient for compensating for a discontinuous fluctuation of an acoustic pressure caused in a joint between frames, calculating the scale factor and scale factor conversion coefficient and inputting them as data to be decoded to said decoding unit if a plurality of scale factors included in the frame are reproduced by said reproduction unit.

4. The data reproduction device according to claim 1, which receives multimedia data, including both video data and audio data, further comprising:

a separation unit breaking down the multimedia data into both video data and audio data;

a decoding unit decoding the video data; and a video reproduction unit reproducing the video data.

5. The data reproduction device according to claim 4, wherein each piece of the video data and audio data is structured as MPEG data.

6. A method for reproducing multimedia data, including audio data which is MPEG audio data and converting a reproduction speed without decoding compressed audio data, comprising:

extracting a frame, which is unit data of the audio data;

setting the reproduction speed of the audio data;

extracting a scale factor included in the frame;

calculating an evaluation function from the extracted scale factor, to thereby provide a calculation result;

comparing the calculation result with a prescribed threshold value, judging to be a sound section frame if the calculation result is larger than the threshold value and, if a sound section frame is judged, speed converting the extracted frame by thinning out the extracted frame or repeatedly outputting the extracted frame;

decoding the speed converted frame; and reproducing audible sound represented by the audio data from the decoded frame.

7. The method according to claim 6, wherein in said calculating, the evaluation function is calculated from a plurality of scale factors included in the frame.

8. The method according to claim 6, further comprising:

generating a scale factor conversion coefficient for compensating for a discontinuous fluctuation of an acoustic pressure caused at a joint between frames and executing said decoding based on a value obtained by multiplying the scale factor by the scale factor conversion coefficient if a plurality of scale factors included in the frame are reproduced.

9. The method for processing multimedia data, including both video data and audio data, according to claim 6, further comprising:

separating video data from audio data;

decoding the video data; and reproducing the video data.

10. The method according to claim 9, wherein each of the video data and audio data is structured as MPEG data.

11. A computer-readable storage medium, on which is recorded a program for enabling a computer to reproduce multimedia data, including audio data which are MPEG audio data by converting reproduction speed of compressed audio data without decoding the data, said process comprising:

extracting a frame, which is a data unit of the audio data;

setting reproduction speed of the audio data;

extracting a scale factor included in the frame;

calculating an evaluation function from the extracted scale factor to thereby provide a calculation result;

comparing the calculation result with a prescribed threshold value, judging to be a sound section frame if the calculation result is larger than the threshold value and, if a sound section frame is judged, speed converting the extracted frame by thinning out the extracted frame or repeatedly outputting the extracted frame;

decoding the speed converted frame; and reproducing audio sound represented by the audio data from the decoded frame.

12. The storage medium according to claim 11, wherein in said calculating, the evaluation function is calculated from a plurality of scale factors included in the frame.

13. The storage medium according to claim 11, further comprising:

generating a scale factor conversion coefficient for compensating for a discontinuous fluctuation of an acoustic pressure caused at a joint between frames and executing said decoding based on a value obtained by multiplying the scale factor by the scale factor conversion coefficient if a plurality of scale factors included in the frame are reproduced.

14. The storage medium for processing multimedia data, including both video and audio data, according to claim 11, further comprising:

separating video data from audio data;

decoding the video data; and reproducing the video data.

15. The storage medium according to claim 14, wherein each of the video data and audio data is structured as MPEG data.

* * * * *